United States Patent [19]

Schaffer

[11] 4,191,043

[45] Mar. 4, 1980

[54] METAL DUCT DRIVE BENDING TOOL

[76] Inventor: Ezra Schaffer, Scottsdale, Ariz.

[21] Appl. No.: 926,659

[22] Filed: Jul. 21, 1978

[51] Int. Cl.[2] ..... B21D 11/20

[52] U.S. Cl. ..... 72/319; 72/458

[58] Field of Search ..... 72/319, 458, 457, 387, 72/388, 379, 310, 316; 113/54, 54 A

[56] References Cited

U.S. PATENT DOCUMENTS

| | | | |
|---|---|---|---|
| 2,401,031 | 5/1946 | Wanasek | 72/319 |
| 2,436,278 | 2/1948 | Willett | 72/319 |
| 3,248,921 | 5/1966 | Trout | 72/319 |
| 3,859,834 | 1/1975 | Riley | 72/319 |
| 3,948,074 | 4/1976 | Stalzer | 72/319 |

FOREIGN PATENT DOCUMENTS

| | | | |
|---|---|---|---|
| 62334 | 6/1925 | Sweden | 72/319 |

*Primary Examiner*—Francis S. Husar
*Assistant Examiner*—Gene P. Crosby
*Attorney, Agent, or Firm*—Harry M. Weiss

[57] ABSTRACT

This disclosure relates to an improved metal duct drive bending tool. The improved metal duct drive bending tool of this disclosure is a portable metal frame type apparatus which uses the pivoting action between two pivotable members of the frame, one of which has teeth, to form a drive at the end of a metal duct that is inserted into a pocket within the frame apparatus between the two pivotable members. The improved metal duct drive bending tool uses the teeth on one of the pivotable members to permit the insertion of various widths of metal duct end portions to be bent.

8 Claims, 11 Drawing Figures

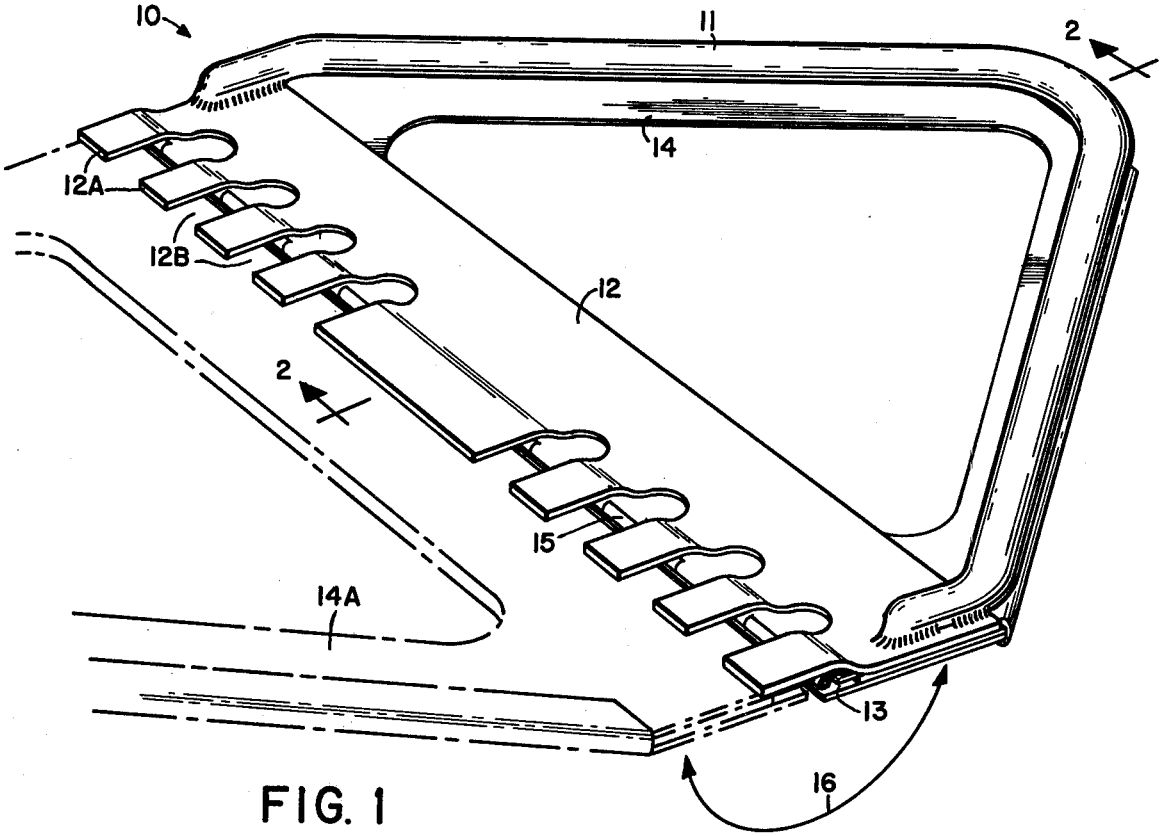
FIG. 1
FIG. 2
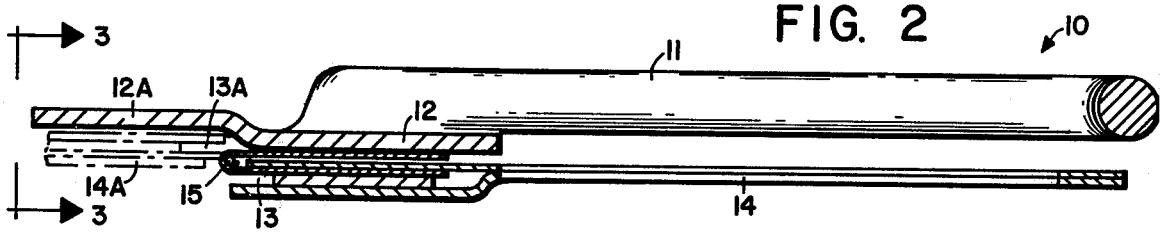
FIG. 3
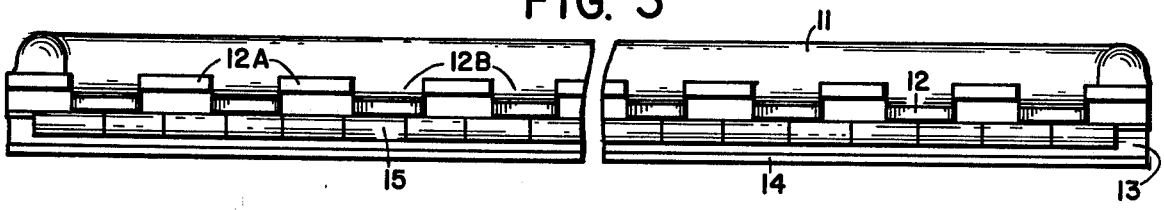
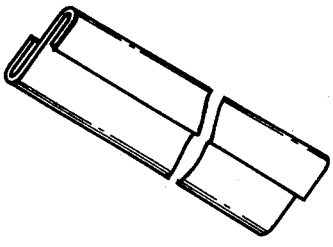
FIG. 10
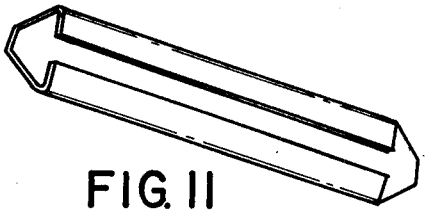
FIG. 11

METAL DUCT DRIVE BENDING TOOL

BACKGROUND OF THE INVENTION

This invention relates generally to metal duct drive bending tools and, more particularly to metal duct drive bending tools that are portable and that can be used to form a drive at the end of a metal duct.

BACKGROUND OF THE PRIOR ART

In the past, metal ducts that were used, for example, in air conditioning or heating system were generally fabricated in various sizes or dimensions and it was important to connect up different sized or dimensioned metal duct units to provide a continuous duct system of a desired length and configuration. Most of the time the metal duct system had to be assembled at the location where the metal duct system was to be installed, however, in order to join a number of various sections of metal ducts to each other it was generally necessary to form a drive at the end portions of the metal ducts in order to couple together the various metal duct sections to form a complete metal duct system. In order for this type of operation to be carried out to form a complete metal duct system, it is necessary for the sheet metal worker assembling the metal system to form the drive at the ends of the metal ducts at the job site where the metal duct system is to be installed. Usually this was accomplished in advance by very heavy, expensive and complex metal duct drive forming equipment that was located back at the sheet metal fabrication shop. However, this was generally undesirable due to the necessity to make modifications and changes at the job site which were not always planned or anticipated prior to the actual assembly, at the site, of the entire metal duct system.

At the sheet metal fabrication shop, the cost of the metal duct drive bending equipment, which was generally hydraulically operated, was thousands of dollars. In some instances, the metal duct drive bending equipment was less costly when it was made non-hydraulically but even this type of equipment was generally bulky, complex, relatively expensive, and usually required quite a bit of experience and understanding in the operation thereof.

In some instances, "hand seamers" usually in the form of a large and wide pair of pliers are used at the job site to achieve the formation of a drive on the ends of the metal ducts. The problems in using these "hand seamers" are the formation of undesired creases and crudely formed drives. Furthermore these "hand seamers" could not shape the drive in one operation, but required a number of continuous manipulations to crudely form the drive. Furthermore, the user of the "hand seamer" had to be very experienced to form a suitable drive.

Thus, a need existed for an easy to use, efficient, quick operating, portable and relatively inexpensive metal duct bending tool that could be used on the site by sheet metal workers assembling units of metal duct work into a total metal duct system.

SUMMARY OF THE INVENTION

Accordingly, it is an object of this invention to provide an improved metal duct drive bending tool.

It is another object of this invention to provide an improved metal duct drive bending tool that is portable, easy to use, efficient, quick operating, and relatively inexpensive.

The foregoing and other objects, features and advantages of this invention will be apparent from the following more particular description of the preferred embodiments of the invention as illustrated in the accompanying drawings.

BRIEF DESCRIPTION OF THE FIGURES

FIG. 1 is a perspective view of the improved metal drive bending tool of this invention showing the metal frame used as the tool in one initial position (solid lines) and in an intermediate position (see FIG. 7) as shown by the dotted lines.

FIG. 2 is a cross-sectional view of the improved metal duct drive bending tool of this invention taken on the line 2—2 of FIG. 1.

FIG. 3 is a side elevational view of the operating portion of the improved metal duct bending tool of FIGS. 1 and 2 taken in the direction of the arrows 3—3 of FIG. 2.

FIG. 10 is a perspective view of a metal "S" shaped cleat member that can be formed using the improved metal duct drive bending tool of this invention so as to permit connection, in an end to end manner, between two end portions of two separate metal ducts.

FIG. 11 is a perspective view of a "Drive" cleat member which can also be formed using the metal duct drive bending tool of this invention.

DETAILED DESCRIPTION OF THE SPECIFICATION

Figure 4:
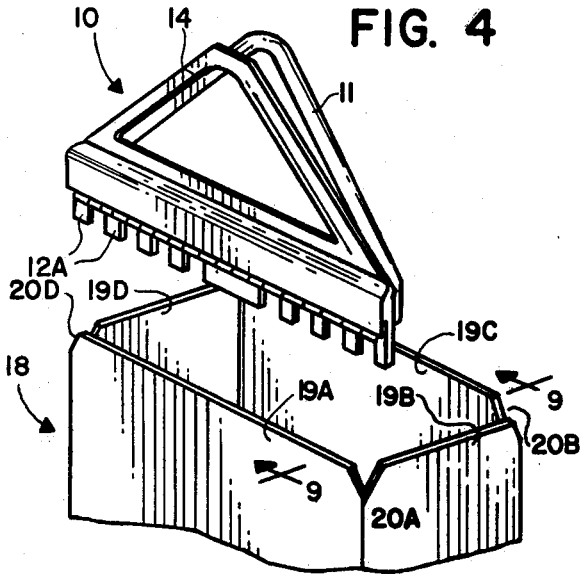
FIG. 4 is a perspective view showing the improved metal duct drive bending tool of FIG. 1 being readied for use in engaging one end portion of a metal duct.

Referring to FIG. 1, a hand tool or metal frame type apparatus 10 depicts the metal duct drive bending tool of this invention. Although the specific description of this hand tool or frame 10 is primarily directed to the application of forming a drive (which is a term of art by sheet metal workers to designate a bend that is formed on the end of a metal duct or a separate metal part with the drive being used to couple together two metal duct end portions to form a continuous integrated duct system) on a metal duct, it should be understood that this metal frame or hand tool 10 can also be used to form curved or coupling ends on, for example, portions of sheet metal material in order to provide a way, for example, to unite sheet metal material elements into a tubular configuration or for other types of sheet metal bending and coupling operations.

The metal frame type apparatus or hand tool 10 of FIG. 1 comprises a metal handle 11 which is preferably made out of a metal such as aluminum, a galvanized metal, steel, etc. This handle 11 can also be made out of a very strong plastic provided that the plastic material is strong enough to withstand the bending and twisting stresses thereon during the metal duct drive bending operation. As shown, the handle 11 is preferably triangular shaped and is formed of tubular shaped metal material in order to facilitate the gripping of the handle 11 and also to provide a strong rib type element for increased structural strength to avoid bending during the operation of forming the metal duct drive using the hand tool 10.

A metal comb type 12 is located across the open end portion of the triangular shaped handle 11 and functions to both hold the handle 11 at the ends thereof and to integrally support a plurality of teeth 12A located at the end portion of the comb 12 that is furthest from the connections to the handle 11. The handle 11 is connected to the comb 12 preferably by welding the ends of the handle 11 to end portions of the comb 12 as shown by the dotted lines in FIG. 1.

Spaces 12B are located between the teeth 12A in order to permit or accomodate the insertion of various sizes or widths of metal duct end portions. Thus, the hand tool or metal frame type apparatus 10 of FIG. 1 can operate on or perform drives on metal duct end portions that have various widths due to the bending pressure provided by the use of the spaced teeth 12A. Thus, different numbers of teeth 12A are used depending upon the size of the width of the metal duct end portion that is inserted into position for operation by the hand tool 10.

Located beneath the teeth 12A is a pocket 13 (see FIG. 2) which serves to permit the metal duct end portions to be inserted therein ready for the metal duct drive bending operation. The pocket 13 runs the longitudinal length of the comb 12 beneath the teeth portions 12A. The pocket 12 (as can best be seen with reference to FIG. 2) is formed by an end portion of a triangular shaped support member 14 and is located beneath a hinge 15 that serves to pivotly connect the triangular shaped handle 11 to the triangular shaped support member 14.

The metal triangular shaped support member is preferably shaped similar to the shape of the handle 11 and rotates or pivots in a substantially circular motion due to the action of the hinge 15. As shown, the handle 11 with its integral comb 12 and the teeth 12A is pivotly connected by means of the hinge 15 to the metal support member 14. The dotted lines in FIG. 1 show the support member 14 after pivoting through the arc 16 to reach the position shown by reference numeral 14A.

Referring to FIG. 2, the dotted lines 13A depict the location of the pocket 13 in a position prior to the movement of the bottom metal support member 14 to the solid line position shown in FIGS. 1 and 2.

Referring to FIG. 3, this is a view showing the teeth 12A from a front view thereof with the spaces 12B shown located between the teeth 12A. The handle 11 is shown on top and the support metal member 14 is shown on the bottom beneath the hinge 15 which is located above the pocket 13 that holds the metal duct end portion that is to receive a drive during the metal duct drive operation.

FIG. 4 is a view showing how the hand tool 10 is about to be inserted over one end portion of a metal duct 18 prior to the metal duct drive forming operation that is carried out by the metal frame type apparatus 10 of this invention. The frame 10 with its handle 11 and its metal support member 14 is shown in a position just prior to connection or coupling to one of the four end portions of the metal duct 18 which is shown to have a rectangular configuration. The metal duct 18 has duct end flaps 19A, 19B, 19C and 19D. Corners of the metal duct are shown by reference numerals 20A, 20B, 20C (see FIG. 5) and 20D. The metal duct end flap 19A is about to be inserted within the pocket 13 of the metal frame type apparatus or hand tool 10 of FIG. 1.

Figure 5:
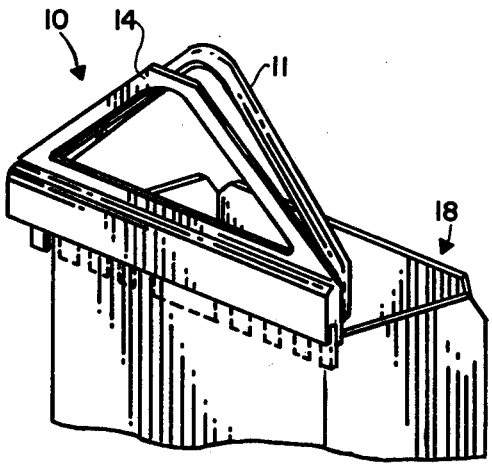
FIG. 5 is effectively the first step in the process of forming a metal duct drive with the improved metal duct drive bending tool of FIG. 1 which is in position on the end portion of the metal duct that is to receive drive operation.

Referring to FIG. 5, this is actually the first operating position of the metal duct drive bending tool 10 of FIG. 1 showing the tool 10 in its contact or coupling position with the metal duct end flap 19A located on the end portion of the metal duct 18. As can be seen, the metal duct end portion or flaps 19A is located within the pocket 13 of the metal frame type apparatus or assembly 10.

Figure 6:
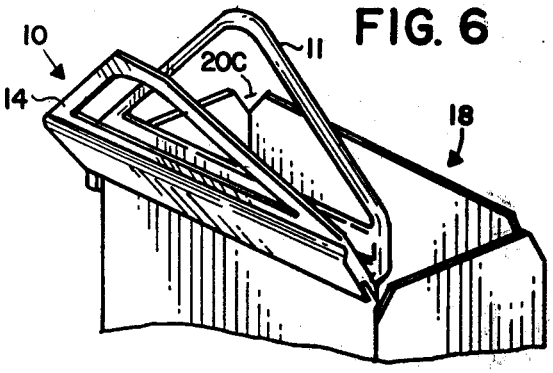
FIG. 6 is the next step in the process of bending the metal duct end portion to form a drive and this figure shows how the frame of the metal duct drive bending tool is pivoted to achieve the desired drive operation.
Figure 7:
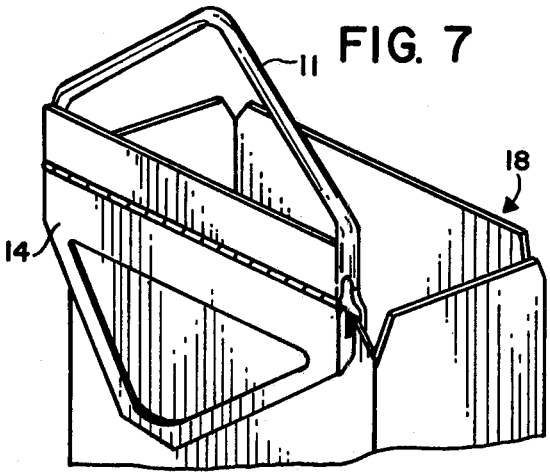
FIG. 7 is the position of the frame of the metal duct drive bending tool of this invention after completion of the formation of the drive.

Referring to FIG. 6, the support portion 14 of the metal frame type apparatus or hand tool 10 is pivotly moved as shown in FIG. 6 from its vertical position towards its lowermost position (as shown in FIG. 7) in order to achieve the formation of the drive (shown more clearly in FIG. 9) on the metal duct end flap 19A of the metal duct 18.

Referring to FIG. 7, the support portion 14 of the metal frame type apparatus or hand tool 10 is in its vertical position which indicates that the drive has been formed on the metal duct end flap 19A of the metal duct 18. In this position, although the drive has been formed and completed, the hand tool or metal frame type apparatus 10 is still firmly engaged with the metal duct end flap 19A of the metal duct 18.

Figure 8:
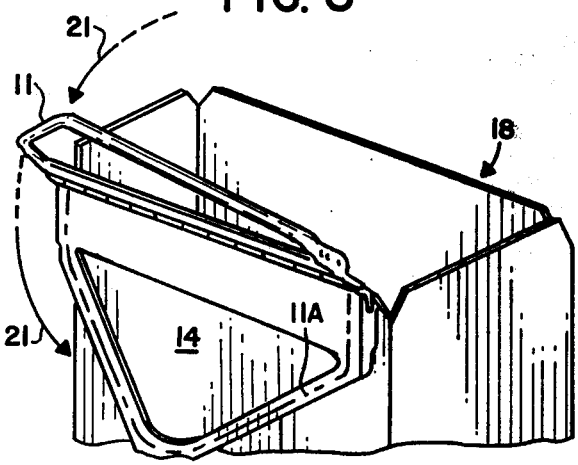
FIG. 8 is a view showing how the metal duct drive bending tool is released from engagement with the metal duct end portion by pivoting together the upper portion of the metal frame towards the lower portion of the metal frame to achieve release.

Referring to FIG. 8, an operation is shown that is carried out to release the end of the metal duct end flap 19A of the metal duct 18 from gripping contact with the metal frame type apparatus or the metal duct drive bending tool 10. The downward movement of the handle 11 (as shown by arrow 21 in this figure) achieves releases of the tool 10 from the metal duct end flap 19A of the metal duct 18. Thus, when the metal handle 11 reaches its bottommost or vertical position substantially next to the support portion 14, the release of the metal duct end flap 19A by the tool 10 is achieved.

Figure 9:
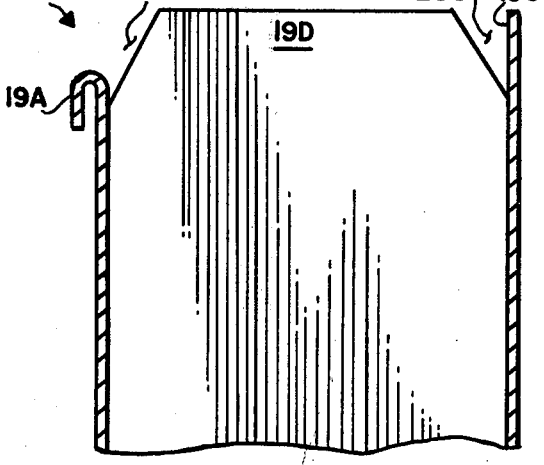
FIG. 9 is a view of the completed drive that is formed on the end portion of the metal duct that was operated upon by the improved metal duct drive bending tool of this invention.

Referring to FIG. 9 the drive that is formed by the tool 10 is shown as a curved end portion on the end of the metal duct and flap 19A of the metal duct 18. This is achieved in the sequence of steps shown in FIGS. 5–8 by use of the hand tool or the metal duct drive bending tool of this invention.

Referring to FIG. 10, it can be seen that use of the metal duct drive bending tool 10 of FIG. 1 can also be used to form two curved portions in a metal element as shown in FIG. 10 to provide what is known in the art as an "S" drive cleat. One or more of these "S" drive cleat metal elements can be used, for example, to connect up separate metal ducts extending in opposite directions by insertion within the two pockets formed by the "S" drive cleat.

Referring to FIG. 11, this figure depicts a "Drive" cleat that can be formed in a separate metal element using the metal duct drive bending tool 10 of FIG. 1.

This is achieved by forming the two curved end portions forming the "Drive" cleat by two separate metal duct drive bending operations on the two end portions of the separate metal member or element that is to be formed with a "Drive" cleat.

The most often used methods of joining one duct or fitting to another is called the "S" and "Drive" methods. Thus, a metal duct having four sides is equipped with two "S" cleats on sides one opposite the other and the two remaining sides are then bent or folded approximately ½" from the edge to 180°, leaving space for the formation of the "Drive" cleat. The hand tool 10 of FIG. 1 is capable of forming both "Drive" and "S" cleats, which is to be used to fold or brake the sheet-metal into "drive" edges which prepares the ducts and fittings to be joined together.

While the invention has been particularly described and shown in reference to the preferred embodiments thereof it will be understood by those skilled in the art that various changes in form and detail and omissions may be made therein without departing from the spirit and scope of the invention.

I claim:

1. A metal duct edge bending tool comprising, in combination, a first member having means for holding an edge portion of a metal duct, said holding means comprising a pocket portion located at one edge portion of said first member, a second member having means located at an edge portion of said second member adjacent said one edge portion of said first member for support against the metal duct held by the holding means of said first member while one of said members bend said held portion more than 90°, and pivoting means for permitting at least one of said first and second members to be pivoted to form a more than 90° bend on the edge portion of the metal duct held by the holding means of said first member, said supporting means of said second member comprising a plurality of spaced apart teeth elements.

2. A metal duct edge bending tool in accordance with claim 1 wherein said pivoting means comprising a hinge connecting said first member to said second member.

3. A metal duct edge bending tool in accordance with claim 2 wherein said pocket portion being located on the opposite side of said hinge from said second member.

4. A metal duct edge bending tool in accordance with claim 1 wherein said second member comprising a triangular shaped metal element.

5. A metal duct edge bending tool in accordance with claim 1 wherein said first member comprising a triangular shaped metal element.

6. A metal duct edge bending tool in accordance with claim 5 wherein said second member comprising a triangular shaped metal element.

7. A metal duct edge bending tool in accordance with claim 6 wherein said triangular shaped metal element of said first member having a handle portion defining an apertured center portion, said triangular shaped metal element of said second member having a handle portion defining an apertured center portion.

8. A method for forming a more than 90° drive on a metal duct end portion comprising the steps of:

inserting a metal duct end portion into a pocket formed by one of two pivoting members of a tool that can hold the metal duct end portion, the other of said two pivoting members having a plurality of teeth located adjacent to the pocket;

pivoting one of the two members of the tool to bend the portion of the metal duct end portion that is held by said one of said members of the tool by the bending action of the holding end portion relative to the plurality of teeth against the metal duct end portion; and pivoting the other of the two members of the tool to release the metal duct end portion from the tool after the formation of a drive thereon.

* * * * *